US006068388A

United States Patent [19]

Walker et al.

[11] Patent Number: 6,068,388

[45] **Date of Patent: *May 30, 2000**

[54] DUAL REFLECTOR LIGHTING SYSTEM

[75] Inventors: William H. Walker, Mission Viejo; James E. Thomas, Murrieta, both of Calif.

[73] Assignee: Eppi Lighting, Inc., San Diego, Calif.

[ * ] Notice: This patent is subject to a terminal disclaimer.

[21] Appl. No.: 08/894,815

[22] PCT Filed: Feb. 28, 1996

[86] PCT No.: PCT/US96/02713

§ 371 Date: Aug. 29, 1997

§ 102(e) Date: Aug. 29, 1997

[87] PCT Pub. No.: WO96/27102

PCT Pub. Date: Sep. 6, 1996

[51] Int. Cl.[7] ..... F21V 7/00

[52] U.S. Cl. ..... 362/304; 362/263; 362/346; 362/443

[58] Field of Search ..... 362/263, 304, 362/346, 277, 281, 319, 443

[56] References Cited

U.S. PATENT DOCUMENTS 5,582,479 12/1996 Thomas et al. ..... 362/277

*Primary Examiner*—Stephen Husar

*Attorney, Agent, or Firm*—Fitch, Even, Tabin & Flannery

[57] ABSTRACT

A dual reflector lighting system (10) having a housing, a ballast and a lamp socket (16) connected to receive a gaseous discharge or high intensity discharge (HID) lamp (14). An outer reflector (21) is mounted to the housing to reflect a portion of light from the lamp (14). An inner or auxiliary reflector (22) is mounted coaxially with the lamp (14) to reflect a substantial amount of light from the lamp (14) downwardly. The auxiliary reflector (22) is preferably adjustable relative to the lamp (14). The invention also covers a dual reflector assembly, including an outer reflector (21) and inner reflector (22), adjustable relative to each other which is adapted to be mounted to a HID fixture. The invention also covers an auxiliary reflector (22) having a predetermined size and shape adapted to fit within an outer reflector (21) of a HID fixture and preferably includes facilities for adjusting the auxiliary reflector (22) relative to the outer reflector (21).

46 Claims, 6 Drawing Sheets

12
10
16
17
18
24
18
23
19
19
26
28
20
25
20
21
22
22
H
27
29
14

FIG. 5A
PRIOR ART
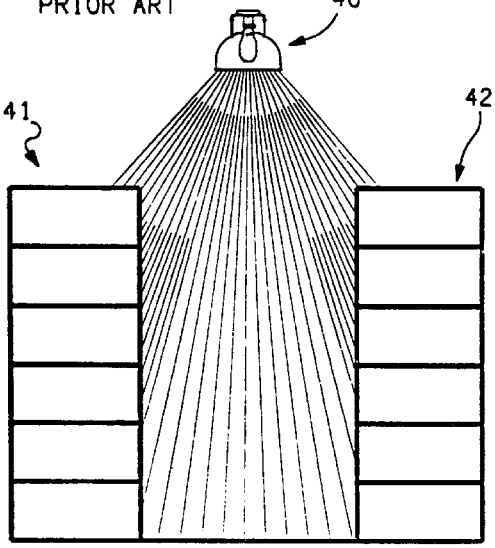
FIG. 5B
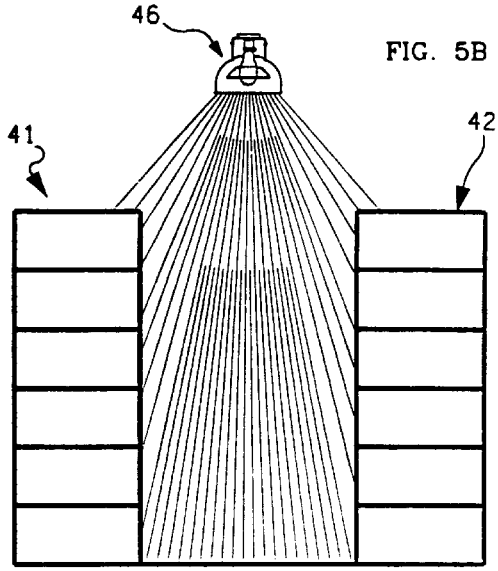
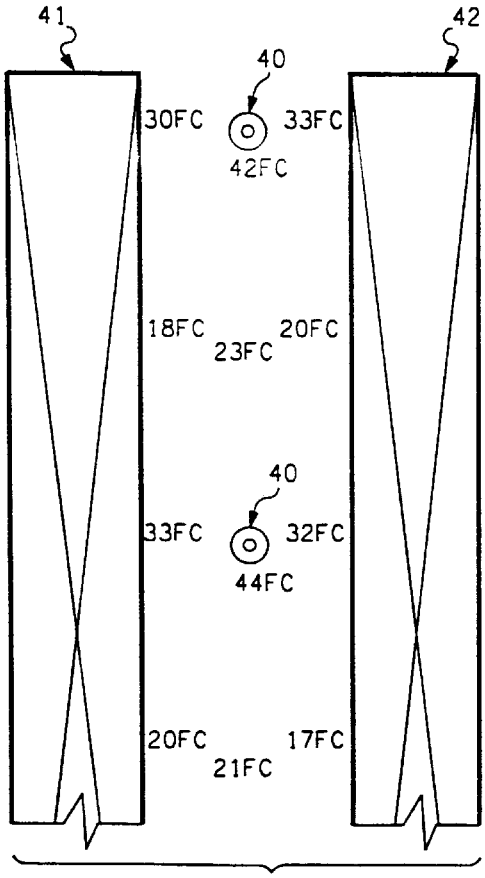
FIG. 6A
PRIOR ART
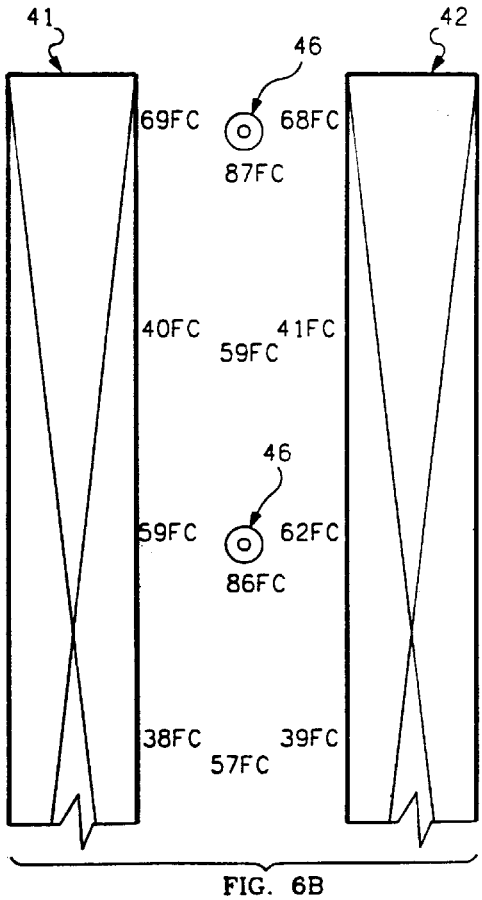
FIG. 6B

DUAL REFLECTOR LIGHTING SYSTEM

TECHNICAL FIELD

This invention relates to an dual reflector lighting system or luminaire having an outer reflector and an auxiliary or inner reflector which distributes the light in a certain way to direct a first predetermined amount of light onto the floor or work area and a second predetermined amount of light above the work area. The subject invention increases the efficiency of the lighting system so that a fixture with a high intensity discharge (HID) lamp of lower wattage can be used to get substantially equal or greater lighting on the work area. Alternatively, a fixture in accordance with this invention which uses the same wattage lamp as a conventional fixture will provide a substantially greater amount of light on the work area. The invention includes a luminaire having a high intensity discharge lamp, an outer reflector, and an auxiliary reflector mounted within the outer reflector and movable relative to the lamp for concentrating light in a first work area beneath the luminaire and providing a certain amount of light outside or above the first area. The invention also covers a dual reflector assembly, including an inner and an outer reflector adjustable relative to each other, the assembly adapted to be mounted to an HID fixture. The invention also relates to an auxiliary reflector and bracket assembly for retrofitting conventional fixtures, and a retrofit kit for retrofitting conventional fixtures of a specific wattage, to dual reflector systems of lesser wattage.

High bay lighting fixtures are typically used in warehouses and manufacturing plants. Such lights are generally referred to as high intensity discharge (HID) lights or gaseous discharge lights. Conventional high bay lighting fixtures direct all of the light equally leaving the areas closest to the fixture too bright and the working areas furthest from the fixture too dim. In a typical warehouse, light fixtures will be between 15 to 65 feet above the floor. Most light is usually required at the working surface or floor level, not at the top of the storage racks or near the ceiling. However, the storage racks require sufficient lighting to enable workers operating fork lifts to have sufficient visibility to remove products from the racks and to store products in the racks. In order to obtain a desired level of light at the working area with such conventional fixtures, a fixture of higher wattage must be used. This creates overly bright conditions closer to the ceiling where it is not needed. In installations in warehouses where there are rows of racks of merchandise, with aisles therebetween, conventional HID lighting systems typically use 400 watt and 1,000 watt luminaires for such installations. The subject invention permits the 400 watt luminaires to be replaced with 250 watt luminaires, and in some instances, 150 watt luminaires, and the 1,000 watt luminaires to be replaced by 400 watt luminaires. When such a replacement is made using the subject invention, the amount of foot candles measured at the floor level is substantially the same, or greater, while the lighting at the top of the racks may be reduced, but is still more than sufficient for workers to be able to function. The energy savings resulting from use of the lower wattage lamps is typically between 40–65%. This results in substantial reduction of energy costs. Not only do customers benefit by a reduction in energy costs by replacing 400 watt fixtures with 250 watt fixtures, or even 150 watt fixtures, but, in installations using air conditioning or refrigeration, they also reduce the amount of air conditioning or refrigeration costs incurred by reducing the heat or kilowatt loading of the work space. Furthermore, they obtain an increase in efficiency from personnel working in a building by having an improved lighting level at the working surface.

BACKGROUND ART

Henderson Jr., et al U.S. Pat. No. 4,173,037 discloses a luminaire lamp support device in which the lamp socket is adjustably mounted on a bracket for adjustment of the socket along a substantially vertical axis. This enables adjustment of the lamp to different positions to obtain various light distribution patterns. The lamp has an outer reflector and an asymmetric inner reflector which is mounted for rotational adjustment about the vertical axis of the luminaire for producing asymmetric distribution of reflected light.

Sholtz U.S. Pat. No. 5,178,452 discloses an operating theater lamp with a outer reflector which illuminates the area of operation and an auxiliary reflector having an outer diameter which corresponds approximately to the inner diameter of the outer reflector and which is arranged inside the outer reflector to deflect a part of the light beam at a steeper or narrow angle into the bottom of a surgical wound.

Wijbenga, et al U.S. Pat. No. 5,251,116 discloses a luminaire for creating a primary beam and a secondary beam.

Baldwin, et al U.S. Pat. No. 4,943,901 discloses a luminaire with auxiliary reflecting means for reflecting light passing through the top opening and for reflecting such light to illuminate stacked material along the edges of the aisle.

Compton U.S. Pat. No. 4,231,080 discloses a luminaire having at least three stack reflector members.

Cochran U.S. Pat. No. 1,286,535 discloses a lighting fixture having a outer reflector and a stationary auxiliary reflector.

None of the foregoing prior art lamps have suggested a solution to the problem of conserving energy in HID fixtures. The cost of energy is rising significantly, and many power companies have offered inducements in the form of rebates to customers to cut down on their energy consumption. Lighting engineers have been forced to specify the use of 400 watt and 1,000 watt luminaires based on requirements to have a specified amount of foot candles at the work surface. Notwithstanding the prior art, no one has recognized the ability to shape and distribute the light pattern in such a way as to concentrate a substantial amount of light onto the work area while leaving a lesser, but still acceptable, amount of light at the middle and top of the racks sufficient to allow workmen to utilize such racks.

DISCLOSURE OF INVENTION

The present invention fills a need for an energy efficient high bay lighting fixture or luminaire which enables fixtures having lamps of reduced wattage to be used to replace higher wattage lamps and fixtures thereby conserving significant amounts of energy. Typically, the replacement of a 400 watt luminaire with a 250 watt luminaire will result in an approximately 40% or greater savings in energy. The present invention relates to a luminaire having a high intensity or gaseous discharge lamp which is mounted with the base up or down in a substantially vertical position. An auxiliary reflector is mounted to the luminaire for coaxial movement relative to the lamp and the outer reflector. The auxiliary reflector is adjustable along the longitudinal axis of the lamp so that a substantial amount of light is reflected from the auxiliary reflector onto a first predetermined area while a smaller amount of light is reflected from the outer reflector onto a second predetermined area outside the first area or onto the racks or stacked merchandise which is positioned closer to the luminaire. The first predetermined area is an area substantially larger than the outer diameter of the outer reflector. It is typically an area that is equal to or greater than the width of an aisle and usually averages ten to fourteen feet in diameter.

In one embodiment of this invention, an auxiliary reflector is mounted to a bracket assembly which is clamped to the lamp socket of a luminaire. The auxiliary reflector could also be attached to the outer reflector of the luminaire. The auxiliary reflector fits within the outer reflector of the luminaire and is adjustable vertically to concentrate a substantial portion of light emanating from the lamp onto a first area of work surface. The remainder of the light is reflected from the outer reflector onto the racks or onto a second area outside of the first area.

In another embodiment of this invention, a dual reflector system is provided which can be attached to the housing of a conventional HID fixture. The dual reflector system includes an outer reflector, an inner reflector and adjustment facilities allowing the inner reflector to be adjusted relative to the outer reflector. The assembly may also include a bracket for attachment to the housing of the fixture.

In another embodiment of this invention, a retrofit kit is provided to retrofit HID fixtures of a first wattage to convert them into a HID fixture of a second lower wattage having an auxiliary reflector in accordance with this invention. The retrofit kit typically includes an auxiliary reflector and bracket assembly, a ballast suitable for an HID lamp of lower wattage and, in some cases, the lower wattage lamp itself.

Further aspects of the present invention will become apparent from the following detailed description when considered in conjunction with the accompanying drawings. It should be understood, however, that the detailed description and the specific examples while representing the preferred embodiments are given by way of illustration only.

BRIEF DESCRIPTION OF DRAWINGS

FIG. 5A is a side elevational view illustrating an aisle and a pair of racks alongside the aisle in a warehouse with a 400 watt metal halide lighting system installed illustrating the distribution of light for the prior art.

FIG. 5B is a side elevational view illustrating an aisle and a pair of racks alongside the aisle in a warehouse with a 400 watt metal halide lighting system illustrating the distribution of light in accordance with the subject invention.

FIG. 6A is a diagrammatic representation illustrating an aisle and a pair of racks alongside in a warehouse with a 400 watt metal halide lighting system illustrating the distribution of light at the working surface for the prior art shown in FIG. 5A.

FIG. 6B is a diagrammatic representation illustrating an aisle and a pair of racks along side the aisle in a warehouse with a 400 watt metal halide lighting system in accordance with this invention illustrating the distribution of light at the working surface using the subject invention.

BEST MODES FOR CARRYING OUT THE INVENTION

The following description is of the best presently contemplated modes of carrying out the inventions. This description is made for the purpose of illustrating the general principles of the invention and should not be taken in a limiting sense.

Figure 1:
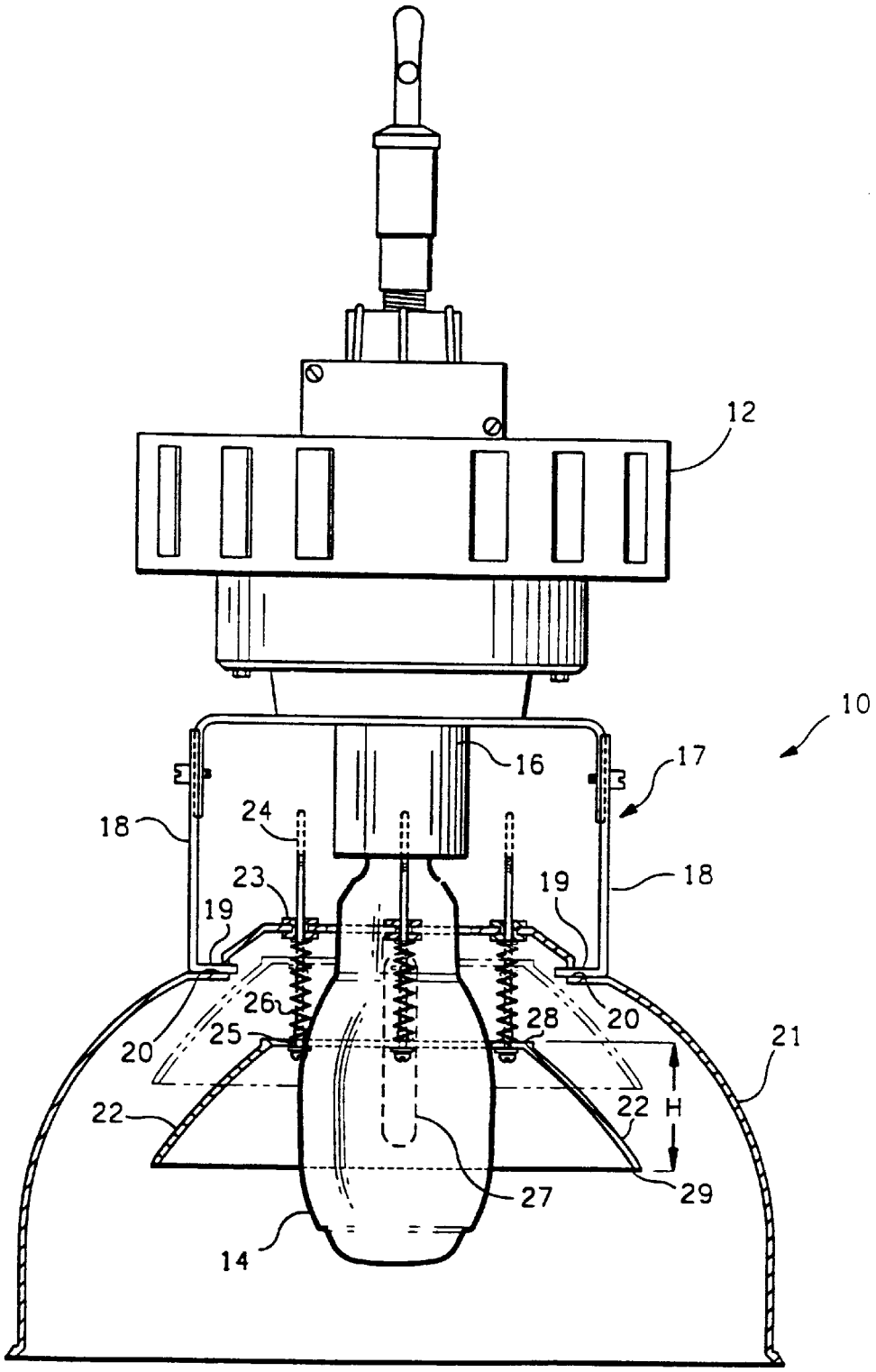
FIG. 1 is a side elevational view of a luminaire in accordance with this invention with the outer reflector and auxiliary reflector both partially broken away.

In accordance with the present invention, there is shown in FIG. 1 a luminaire generally designated as 10 having a casing 12 which contains the ballast (not shown) and a high intensity discharge lamp 14 which is mounted substantially vertically with its base up into a socket 16. The casing has a bracket assembly 17 connected thereto which has a pair of downwardly extending legs 18. The legs 18 each have a short inwardly projecting horizontal section 19 which fits into a slot 20 in a outer reflector 21. The outer reflector 21 may also be fastened to the bracket 17 in other ways conventional in the art. The bracket assembly 17 is adjustable by a slot and screw arrangement at 15 to permit initial adjustment of the distribution of light from the outer reflector 21.

While the vertically mounted lamp is often referred to in a base up position, it can also be used in a base down position for indirect lighting. Thus, light will be reflected upwardly from the lamp onto a ceiling from which it is then reflected down. Such lights are used for indirect lighting, for example, in indoor tennis courts, to avoid glare to the players when they look up. Also, while the lamp is described for many types of installations as being vertically mounted, this is meant to distinguish over fixtures using horizontally mounted lamps. The lamp need not be vertical to be used with the subject invention, as long as the inner reflector is movable coaxially along the axis of the lamp. For example, dual reflector HID flood lights in accordance with this invention are positioned and used with the lamp at various angles to the vertical. The subject dual reflector assembly is mounted coaxially with the lamp. This arrangement provides a highly effective flood light which can concentrate its light by adjustment of the inner reflector as described herein.

An auxiliary reflector 22 is mounted for movement relative to the main reflector 21 and lamp 14 by any number of suitable attachment means. As shown in FIG. 1, in a preferred embodiment, the outer reflector 21 has two or more threaded members 23, such as internally threaded rivets, mounted in the top thereof. While a threaded member 23 is shown, it is apparent that it need not be inserted into the outer reflector. If the upper surface of the reflector is thick enough, a hole could be drilled and tapped to receive a screw or bolt. Alternatively, a wing nut, nut or other threaded member could rest on or be secured to the top of the outer reflector 21. A threaded fastener 24, such as a screw or bolt, passes through a corresponding hole 25 in the top of the auxiliary reflector 22 and screws into each threaded member 23. A spring 26, or other biasing means, could be used to maintain the desired spacing between auxiliary reflector 22 and outer reflector 21. Alternatively, a nut could be threaded on the fastener 24 and fixed down on top of the auxiliary reflector in place of using a spring. The use of the spring merely facilitates installation and adjustment of the auxiliary reflector. The threaded portions of the fasteners may be marked with lines or colors to permit the electrician or installer to evenly adjust the fasteners so that the top of the auxiliary reflector 22 is parallel to and evenly spaced from the top of outer reflector 21.

Instead of using bolts, a tubular member (not shown) could be used to connect the outer reflector and the auxiliary reflector. The upper end of the tubular member could be threaded to engage a threaded area formed in the top of the outer reflector. The bottom end of the tubular member could be fixed to the auxiliary member or could also be threaded to engage a threaded area formed in the top of the auxiliary member.

Figure 2:
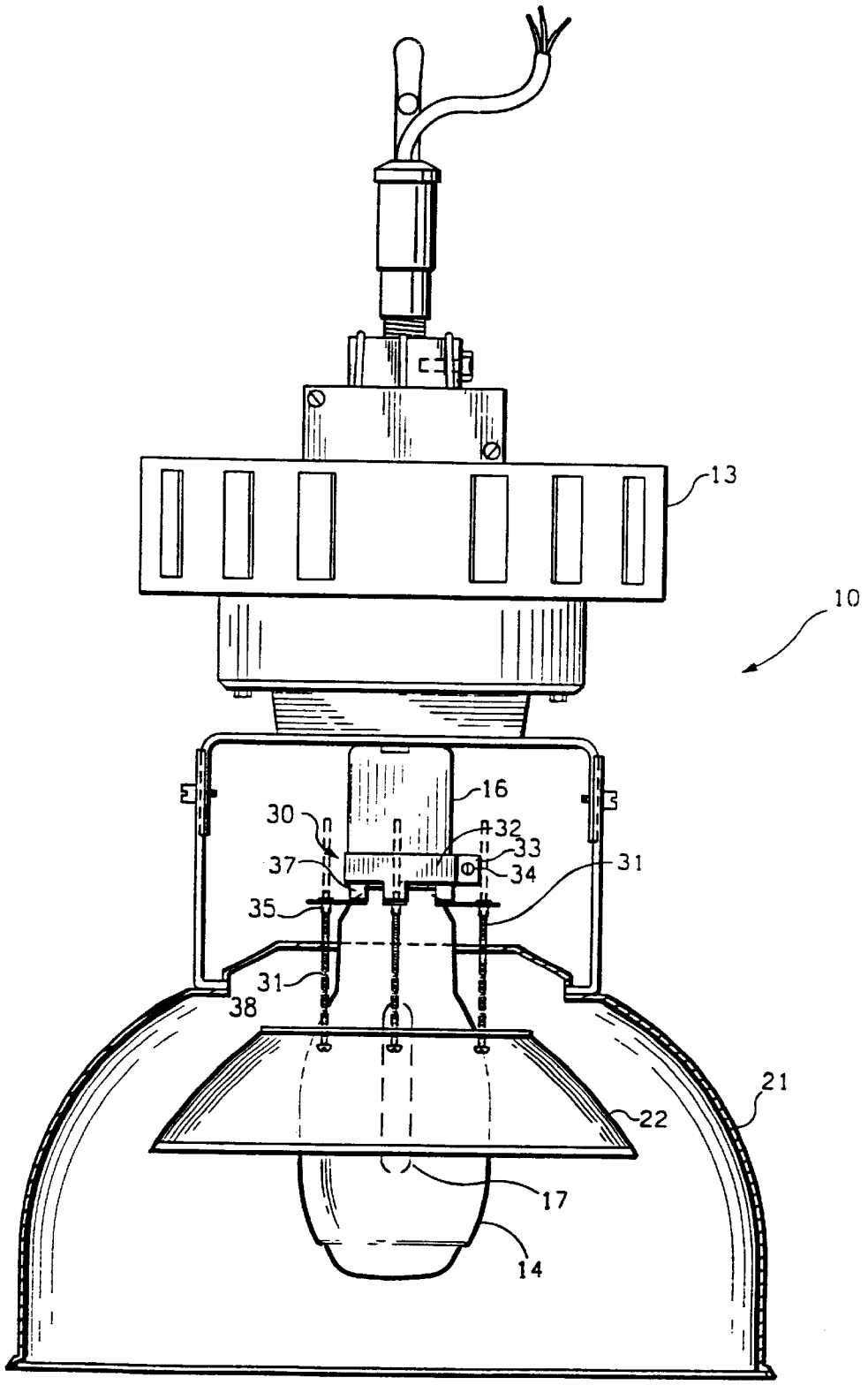
FIG. 2 is a side elevational view with the outer reflector broken away illustrating an alternative embodiment of the subject invention.

Every gaseous discharge lamp has an arc tube therein which is designated by the dotted lines 27 in the lamp 14. The adjustability of the auxiliary reflector 22 is preferably between the range of having the top of the auxiliary reflector 22 substantially even with the upper end of the arc tube 27 at its upper position as shown by the dotted line position in FIG. 1. The lower range preferably has the top of the reflector 22 about even with the midpoint of the arc tube 27 at its lower position, as shown by the lower solid line position of auxiliary reflector 22 in FIG. 1. The preferred position is about midway between the upper and lower position as shown in FIG. 2 where about one inch of the arc tube 27 is above the upper surface 28 of auxiliary reflector 22. Notwithstanding the foregoing, however, it has been found that there are applications where the top of the auxiliary reflector is positioned well above the upper end of the arc tube. In this case, there is still substantial concentration of light onto the work surface by the auxiliary reflector.

The adjustment of the auxiliary reflector 22 relative to the lamp 14 and the outer reflector 21 depends upon a number of factors, including the height of the fixture, the type and wattage of lamp used, the distance to the work surface and the width of the aisles. While the work surface is frequently referred to as the floor, it is to be understood that, for task lighting, the work surface could be a table, or conveyor belt or some other raised surface on which people are working.

In describing the subject invention, the term "watts" is meant to be the energy consumed by the source to generate the lumens. The term "lumens" is meant to be the amount of light generated from a source. A lamp of lower wattage will generate lower lumens than a lamp of higher wattage. The term "foot candles" is meant to define the amount of light as measured by a light meter at a particular point.

In the subject invention, even though the replacement of a 400 watt lamp with a 250 watt lamp lowers the amount of lumens, it has been found that the same or greater foot candles can be measured at the working surface. If the lumens of the lamp are the same, it has been found that, by using a fixture in accordance with the subject invention, you can substantially increase the amount of foot candles measured at the working area. For example, in a 30' high installation with a 400 watt conventional luminaire, you might measure 10 foot candles at the work surface. With a fixture in accordance with this invention, foot candle readings of 40 to 80 foot candles are obtained at the work surface. The size of the auxiliary reflector 22 is very important. If the reflector diameter is too big, you do not get the desired distribution of light at the working area. If the diameter of the auxiliary reflector is too small, you get a concentration of light on the work area. which is visible as a hot spot. Ideally, hot spots are to be avoided so that there is a uniform distribution of light on the work surface or floor so that people do not notice a significant change in light as they walk from one fixture to another. Also, if the diameter of the auxiliary reflector is sized incorrectly, you may not get the desired amount of light on the racks above the working area.

The shape of the auxiliary reflector 22 is also very important. If the shape of the auxiliary reflector is such that light is reflected back from the auxiliary reflector onto the lamp, particularly in the area of the arc tube 27, it raises the temperature of the lamp which increases its voltage and decreases lamp life. Increased voltage also causes the lamp ballast to break down, hence, this is to be avoided. Consequently, it is desirable that the shape of the auxiliary reflector 22 is such that substantially all the light impinging upon the auxiliary reflector 22 from the lamp 14 is directed downwardly with little or no reflection back at the lamp itself. Ideally, the curve of the auxiliary reflector concentrates light emanating from the arc tube 27 and reflects it downwardly at the work area.

The height of the auxiliary reflector 22 is the distance indicated by the letter H in FIG. 1 between the upper surface 28 of the auxiliary reflector and the plane of the lower edge surface 29. If the auxiliary reflector height H is too high, light rays will be reflected back at the lamp 14 and decrease the lamp life as previously described. Also, too much light may be directed at the work area, leaving too little light to be distributed higher at the racks. If the height of the auxiliary reflector 22 is too small, a sufficient amount of light will not be concentrated at the work surface.

It has also been found that the heat generated by the lamp 14 causes air to rise and flow into the bottom of the outer reflector 21 and through the hole in the top of the outer reflector 21. With the use of an auxiliary reflector 22, it has been found that a venturi effect is created between the outside of the auxiliary reflector 22 and the inside of the outer reflector 21 which causes air to flow at increased speed through the fixture thereby cooling both the outer reflector 21 and the auxiliary reflector 22. In many cases, the auxiliary reflector 22 is cool enough to touch, even when the lamp has been on for a long period of time. This air flow also facilitates keeping the reflectors relatively clean.

The material of which the auxiliary reflector 22 is made is selected to dissipate the heat generated by the lamp 14 which also helps to keep the lamp cool. Preferably, an aluminum material is used.

The desired position of the auxiliary reflector relative to the arc tube 27 in the lamp is such that a substantial portion of the light coming from the arc tube 27 will be reflected off of the inner surface of the auxiliary reflector 22 and directed downwardly in a desired pattern onto a first predetermined area, namely, the work surface. The rest of the light, which strikes the outer reflector 21 from both the top and the bottom of the lamp 14, will be widely dispersed onto a second predetermined area which illuminates the sides of the racks or areas above the immediate work area, or the areas of the work surface outside of the first predetermined area. It has been found that the auxiliary reflector 22 can be adjusted so as to eliminate any hot spots on the floor or work area. Hot spots are areas of greater illumination which are visible to the human eye. When the auxiliary reflector 22 is adjusted so as to eliminate hot spots, aisles and work areas have a relatively uniform distribution of light thereon.

It has also been found that the preferred location of the auxiliary reflector 22 is to have the top surface 28 positioned about one inch or so below the top of the arc tube 17. It has been found that when the auxiliary reflector 22 is in this preferred position, the fixture will draw a lower amount of watts. For example, with a conventional 250 watt metal halide fixture, the lamp and ballast pulls about 305 watts through the line. When an auxiliary reflector 22 is installed in accordance with this invention and properly positioned with respect to the lamp 14, the lamp and ballast pulls about 296 watts through the line. By decreasing the watts, the life of the lamp and the ballast is increased and, also, there is an additional energy savings. It is believed that this reduction in wattage results from a decrease in temperature by preventing light rays reflected from the outer reflector 21 from impinging upon the lamp 14 and, in particular, the arc tube 27 area of the lamp. Further, a reduction in temperature is realized by shaping the auxiliary reflector in such a way that little or no light is reflected from the auxiliary reflector 22 back into the arc tube area of the lamp 14. Also, the venturi effect previously described helps to reduce the temperature of both reflectors and, likely, the temperature of the lamp.

While the subject invention is defined as a high bay fixture or luminaire, "high bay" is meant herein to cover any installation where the fixture is mounted high off the ground or floor. This would include such other applications as street lighting, parking lot lighting, building flood lighting, flood lights, low bays, and sports lighting. Furthermore, while the fixtures shown do not have a lens, panel or shield covering the bottom of the fixture as in dust proof fixtures, such a dust proof fixture could be utilized in accordance with this invention. While numerous mention is made of warehouses with racks, it is, of course, evident that the subject invention can be used in applications where there are no racks, but where there is a desire to use energy efficient lighting and to drive a significant amount of the light from a fixture mounted high off the floor onto the working surface.

Figure 3A:
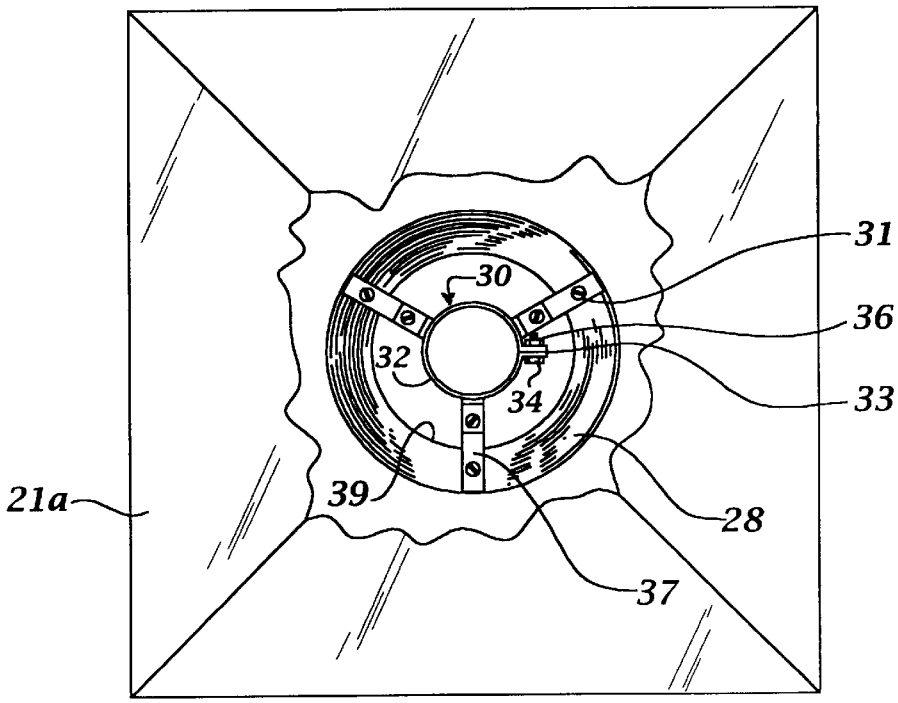
FIGS. 3A and 3B are top plan views of the auxiliary reflector and bracket shown in FIG. 3 having square and rectangular outer reflectors in place thereabout which are broken away in the center portions thereof.
Figure 3B:
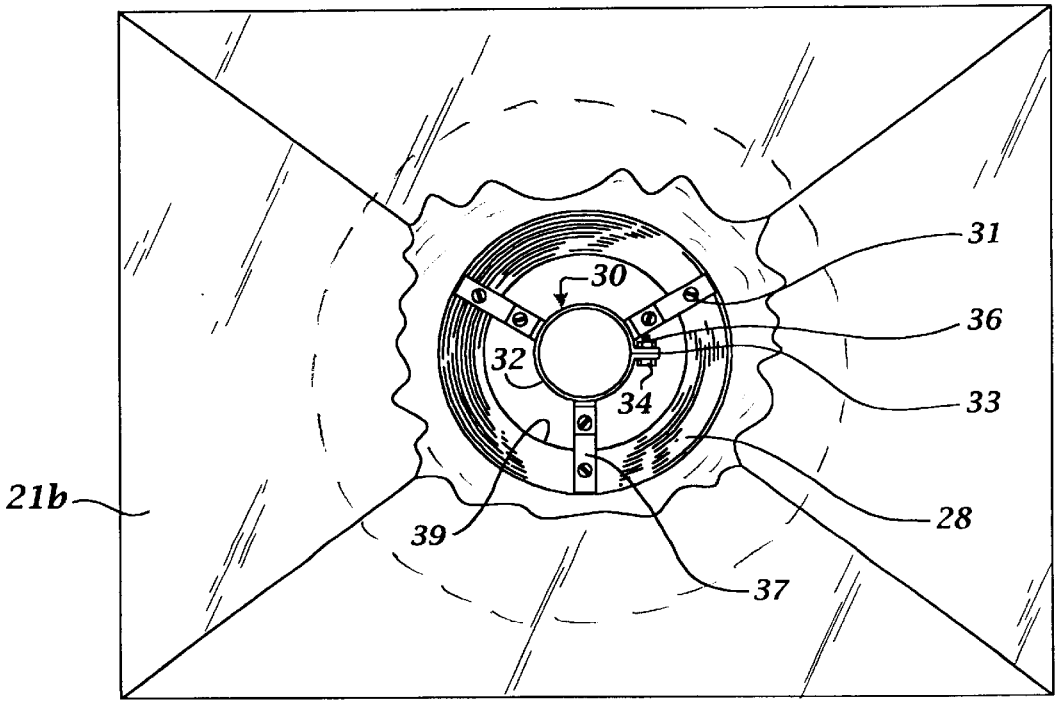

While in most cases the outer reflectors are opaque and typically made of metal, the outer reflectors may also be translucent or transparent and made of acrylic or glass or other materials which allow light to pass therethrough. Such acrylic or glass reflectors may reflect little or no light downwardly. Nevertheless, such reflectors are included within the definition of the term outer reflector as used herein. Consequently, when acrylic or glass outer reflectors are used, the auxiliary reflector is even more necessary and effective in concentrating a substantial portion of light onto the floor while allowing the translucent or transparent outer reflector to pass light therethrough. Additionally, the outer reflector in many cases has a circular cross section, as does the inner reflector, and the inner reflector is concentric with the outer reflector. This is not necessary in all applications, however. For example, a square or rectangular outer reflector could be used with an inner reflector having a circular cross section, as shown in FIGS. 3A and 3B wherein outer reflectors 21*a* and 21*b* are illustrated. Also, different shapes of inner reflectors could also be used in accordance with the principles of this invention.

Figure 3:
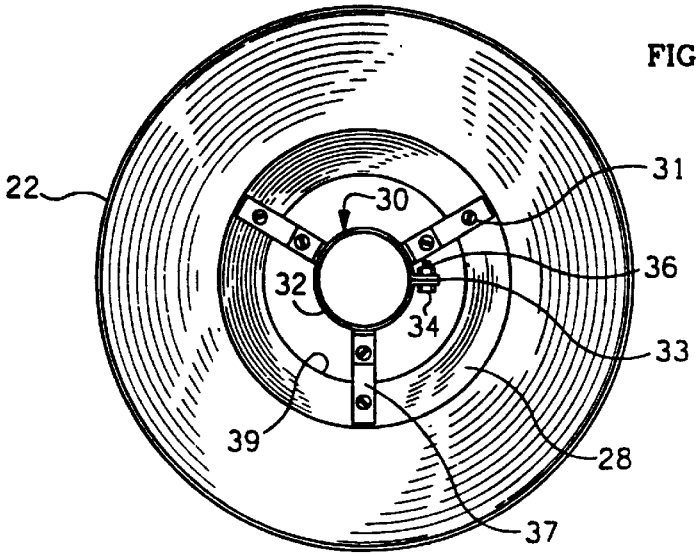
FIG. 3 is a top plan view of the auxiliary reflector and bracket shown in the FIG. 2 luminaire.

Referring now to FIG. 2, there is shown an alternative embodiment of the subject invention in which the auxiliary reflector 22 is mounted to the lamp socket 16 by a bracket assembly 30 instead of directly to the outer reflector 21. In this embodiment, three equidistantly spaced holes are drilled in the top of the outer reflector 21. Three corresponding holes are formed in the auxiliary reflector 22. As shown in FIGS. 2 and 3, three fasteners 31 which pass through the holes in the auxiliary reflector and outer reflector connect the auxiliary reflector 22 to the lamp socket 16 and provide stability for the auxiliary reflector 22. A minimum of two fasteners 31 should be used, although at least three are preferred for stability. The bracket assembly 30 includes a flexible, metal band 32 which fits around socket 16. The metal band 32 has a pair of projections 33 which can separate to allow installation of the band 32 about the socket 16 without removing the lamp 14, if desired. To secure or clamp the bracket assembly 30 to the socket 16, the projections 33 are fastened together by screw or bolt 34 and nut 36 as shown in FIG. 3. The bracket assembly 30 can be adjustably connected to the socket 16 anywhere along its length. This provides two separate adjustment facilities, one being the bracket assembly 30 and the other being the fasteners 31 as described hereafter. Attached to or formed integrally with the band 32 are a plurality of L-shaped or outwardly projecting brackets 37. The free end of each bracket 37 either has a hole therethrough or a threaded member, such as an internally threaded rivet 35, therein for receiving the threaded end of the fasteners 31. The fasteners 31 are typically adjusted by the electrician or installer from inside the auxiliary reflector 22, but, if desired, they can be mounted the other way and adjusted from the top. A plurality of springs or other biasing means could be used as described in FIG. 1 to bias the auxiliary reflector 22 away from the brackets 37 which are clamped to lamp socket 16. As discussed, the auxiliary reflector 22 is adjusted relative to the lamp 14 so that a significant amount of light from arc tube 27 is reflected by the inner surface of the auxiliary reflector 22 downwardly to the working area. Normally, the top surface 38 of the auxiliary reflector 22 is positioned near the top of the arc tube 27 and is then adjusted downwardly until hot spots appear. Then, the auxiliary reflector 22 is then adjusted upwardly until the hot spots disappear. This adjustment provides maximum work area light distribution.

Referring now to FIG. 3, there is shown a top view of the auxiliary reflector 22. It can be seen that there is an upper flat surface 28 of the auxiliary reflector 22 which has a hole 39 therein. The hole 39 is preferably as small as possible to reflect most light down to the work area. The size of the hole 39 in an auxiliary reflector 22 for a high pressure sodium lamp is typically about three inches. For a metal halide lamp which has a larger diameter, the hole 39 is typically about four inches. Too big a hole allows too much light to escape upwardly unless such an effect is desired. Too small a hole prevents lamp adjustment or, if the inner diameter of the hole 39 is too close to the lamp, can cause an arc across the lamp.

The inner surface of the auxiliary reflector 22 is preferred to be concave and smooth from the outside diameter of the upper surface 28 down to the outside diameter of the plane of the lower surface 29. Preferably, the inner surface of the auxiliary reflector is polished to more efficiently reflect light. Other known finishes can also be used.

Figure 4:
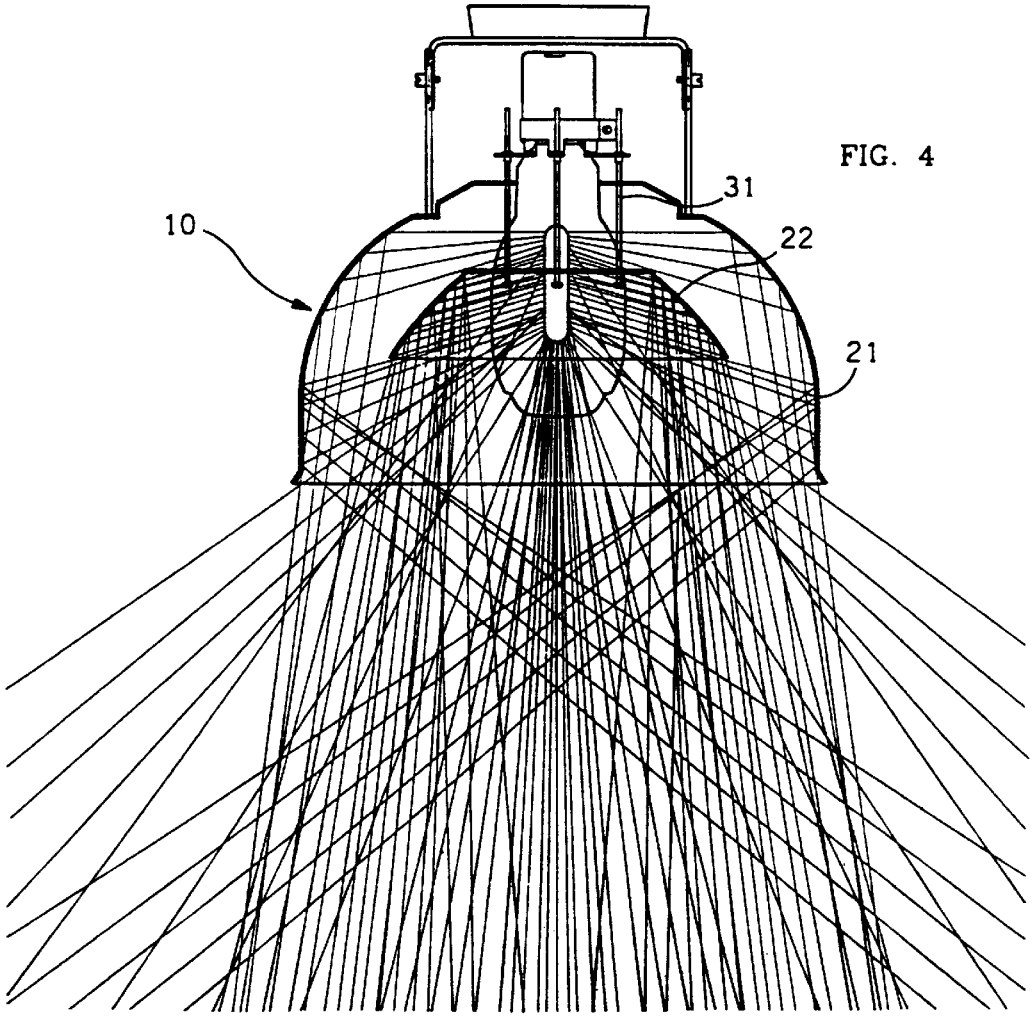
FIG. 4 is a side elevational view of a luminaire in accordance with this invention with the outer and auxiliary reflectors partially broken away to illustrate the distribution of light achieved in accordance with this invention.

Referring to FIG. 4, there is shown a representation of the concentration of the light rays by the auxiliary reflector 22 illustrating how the light is concentrated in the work area generally designated by the plurality of lines directed downwardly. It can be further seen that a sufficient amount of light bounces off the outer reflector as illustrated by the light rays which are directed to the sides.

Referring to FIG. 5A, there is shown an example of a typical high bay lighting installation with a fixture generally designated as 40 and a pair of racks 41 and 42 which are spaced 14 feet apart. The fixture 40 is a conventional 400 watt metal halide fixture. The fixture 40 is positioned 28 feet above the floor of the warehouse, and the spacing between fixtures is 25 feet.

In FIG. 5B, the fixture 46 is a dual reflector 400 watt metal halide fixture in accordance with the subject invention. The concentration of the light rays at the work surface is evident and illustrates that most of the light is driven downwardly by the auxiliary reflector to the work surface.

Referring to FIGS. 6A and 6B, there is shown the same fixtures as described in FIGS. 5A and 5B respectively. Foot candle measurements are taken on the working area, namely, the floor. These measurements were taken at night to avoid increased measurements due to natural or ambient light. In FIG. 6A, the fixtures are designated as 40, and in FIG. 6B, the fixtures of the subject invention are designated as 46. In comparing the foot candle measurements of FIG. 6B to the foot candle measurements of FIG. 6A, it is evident that the amount of light distributed to the work area is substantially increased by the use of the subject invention. Thus, it is apparent that, with the use of the dual reflector, a substantial amount of light is concentrated at the work area and is being driven down from the fixture to the floor.

Figures 7A, 7B:
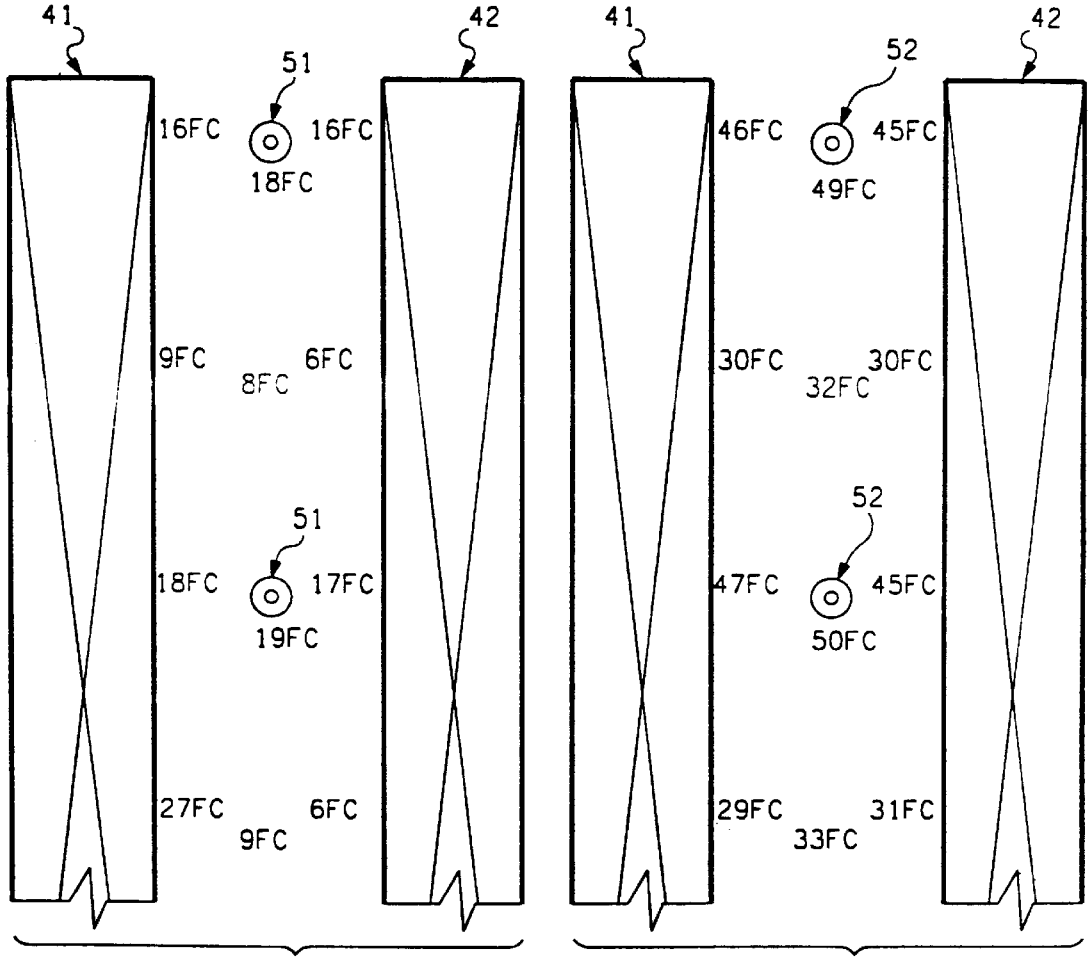
FIG. 7A PRIOR ART
FIG. 7A is a diagrammatic representation illustrating an aisle and racks along the sides of the aisle in a warehouse with a 250 metal halide lighting system illustrating the distribution of light at the work surface for the prior art.
FIG. 7B is a diagrammatic representation illustrating an aisle and racks along the sides of the aisle in a warehouse with a 250 watt metal halide lighting system in accordance with this invention illustrating the distribution of light at the work surface using the subject invention.

Referring now to FIG. 7A, there is shown a plurality of prior art fixtures 51, each of which is a 250 watt metal halide fixture. In FIG. 7B, there is shown a plurality of 250 watt metal halide dual reflector fixture 52, in accordance with this invention, is shown. The height and spacing are the same as set forth above with respect to FIGS. 5A, 5B, 6A and 6B. The foot candle readings in FIGS. 7A and 7B, also taken at night, illustrate that a substantially increased amount of light is concentrated at the work area in the 7B fixture in accordance with the subject invention. Furthermore, the foot candle measurements generated by the 250 watt fixture of this invention in FIG. 7B compare favorably with the 400 watt prior art fixture 40 measurements shown in FIG. 6A. This illustrates how a 250 watt fixture in accordance with this invention can replace a 400 watt conventional fixture.

The subject invention is applicable to any luminaire using a high intensity discharge lamp. including those which are dust proof and have a lens, or shield, at the bottom of the outer reflector. It is also applicable to site lighting and shoeboxes which are usually square or rectangular, but sometimes round, enclosures having a vertically mounted HID lamp and a reflector mounted therein. In such a case, the auxiliary reflector of this invention can be adapted to be mounted coaxially about the vertically oriented lamp to concentrate light downwardly. Further, adjustment facilities may not be necessary if the height of the installation is known, wherein the auxiliary reflector could be fixed in position at the factory. The auxiliary reflector could be fixed in position for high bays as well, but this is not practical since warehouse and factory ceilings vary greatly in height, and the adjustment facilities allow the installer to optimize the setting of the inner reflector on site. In addition, the subject invention is applicable to increasing the efficiency of existing fixtures, in which case an auxiliary reflector 22 and bracket assembly 30 as shown in FIG. 2 could be mounted to an existing fixture to increase the amount of light distributed onto the working surface. Alternatively, the invention can be used to retrofit an existing luminaire by changing its ballast and lamp to a lower wattage and then installing an auxiliary reflector 22 and bracket assembly 30 so that a substantially equivalent or greater amount of light could be distributed at the work surface while saving a significant amount of energy.

This invention also includes a retrofit kit which includes at least an auxiliary reflector, mounting facilities for connecting the auxiliary reflector to a luminaire, means for adjusting the auxiliary reflector relative to the lamp, and a ballast. A new lamp may or may not also be included in the retrofit kit. It is well known that lamps in the subject high bay luminaires cannot merely be replaced with a lamp of a lower or higher wattage. Rather, a new ballast must be installed corresponding to the type and size of lamp utilized.

Although the present invention has now been described in terms of certain preferred embodiments and exemplified with respect thereto, one skilled in the art will readily appreciate the various modifications, changes, omissions and substitutions may be made without departing from the spirit and scope thereof. It is intended that the present invention be limited solely by the scope of the following claims:

What is claimed is:

1. A dual reflector lighting system comprising:

a housing having a ballast and a lamp socket electrically connected thereto to receive a gaseous discharge lamp;

an outer reflector mounted to said housing to reflect a portion of light from said lamp; and an auxiliary reflector mounted within said outer reflector about said lamp to reflect a substantial amount of light from said lamp onto a first predetermined area substantially larger than the outer diameter of said outer reflector.

2. A dual reflector lighting system as set forth in claim 1 comprising:

means for adjusting said auxiliary reflector relative to said outer reflector.

3. A dual reflector lighting system as set forth in claim 1 comprising means for adjusting said auxiliary reflector relative to said lamp.

4. A dual reflector lighting system as set forth in claim 1 wherein said auxiliary reflector is concentrically mounted within said outer reflector.

5. A dual reflector lighting system as set forth in claim 4 wherein said outer reflector and auxiliary reflector are circular in cross section.

6. A dual reflector lighting system as set forth in claim 2 wherein said outer reflector has at least two threaded holes therein;

said auxiliary reflector has at least two holes in alignment with said holes of said outer reflector; and said adjusting means includes at least two elongated threaded members for adjustably interconnecting said outer reflector and said auxiliary reflector.

7. A dual reflector lighting system as set forth in claim 2 including means for biasing said auxiliary reflector away from said outer reflector.

8. A dual reflector lighting system as set forth in claim 1 including means for connecting said auxiliary reflector to said lamp socket.

9. A dual reflector lighting system as set forth in claim 8 wherein said connecting means includes:

a flexible band surrounding said lamp socket and spaced from said auxiliary reflector;

means for interconnecting said flexible band and said auxiliary reflector; and means for securing said flexible band to said lamp socket.

10. A dual reflector lighting system as set forth in claim 1 wherein said lamp has an arc tube therein and said auxiliary reflector is positioned to surround a substantial portion of said arc tube.

11. A dual reflector lighting system as set forth in claim 1 wherein said lamp has an arc tube therein oriented along the vertical axis of said lamp and the height of said auxiliary reflector is less than the length of said arc tube.

12. A dual reflector lighting system as set forth in claim 11 wherein a substantial amount of the light emanating from said arc tube is reflected downwardly by said auxiliary reflector.

13. A dual reflector lighting system as set forth in claim 1 wherein said outer reflector is rectangular in cross-section and said auxiliary reflector is circular in cross-section.

14. A dual reflector lighting system as set forth in claim 1 wherein said outer reflector is square in cross-section and said auxiliary reflector is circular in cross-section.

15. A dual reflector lighting system as set forth in claim 1 wherein said outer reflector allows some transmission of light therethrough.

16. A dual reflector lighting system as set forth in claim 3 wherein said outer reflector allows some transmission of light therethrough.

17. An auxiliary reflector for gaseous discharge luminaires having a gaseous discharge lamp and an outer reflector surrounding said lamp comprising:

an auxiliary reflector having a size and shape adapted to fit within the outer reflector and coaxially about said lamp; and means for connecting said auxiliary reflector to said luminaire and adjusting said auxiliary reflector along the axis of said lamp so that a first portion of light is distributed in a first pattern substantially larger than the diameter of the outer reflector on a work surface, and a second portion of light is distributed in a second pattern outside of said first pattern.

18. An auxiliary reflector as set forth in claim 17 wherein said first pattern is substantially uniform.

19. An auxiliary reflector as set forth in claim 17 wherein said first pattern is substantially circular.

20. An auxiliary reflector as set forth in claim 17 wherein the auxiliary reflector has a flat upper surface having a hole therein for receiving the lamp and having a concave inner surface shaped to direct substantially all of the light impinging on the auxiliary reflector downwardly in said first pattern onto the work surface.

21. An auxiliary reflector as set forth in claim 17 wherein said lamp is connected to a lamp socket and said connecting and adjusting means comprises a bracket assembly having a first end clamped to said lamp socket, and a second end connected to said auxiliary reflector.

22. An auxiliary reflector as set forth in claim 17 wherein said connecting and adjusting means includes a plurality of fasteners connecting said auxiliary reflector to said outer reflector.

23. An auxiliary reflector as set forth in claim 22 wherein said fasteners are marked to permit uniform adjustment of said fasteners to position the top of said auxiliary reflector substantially parallel to the top of the outer reflector.

24. An auxiliary reflector as set forth in claim 17 wherein said connecting and adjusting means includes means for biasing said auxiliary reflector away from said outer reflector.

25. An auxiliary reflector as set forth in claim 21 wherein said connecting and adjusting means includes means for biasing said auxiliary reflector away from said end of said bracket assembly clamped to said lamp socket.

26. An auxiliary reflector as set forth in claim 17 wherein said auxiliary reflector is adapted to be mounted concentrically with said outer reflector.

27. An auxiliary reflector as set forth in claim 17 wherein said gaseous discharge lamp has an arc tube therein, and the height of said auxiliary reflector is less than the length of said arc tube.

28. An auxiliary reflector as set forth in claim 17 for illuminating an aisle and racks positioned on each side of said aisle wherein said first pattern is at least as wide as the width of said aisle, and said second pattern illuminates the racks above the work surface.

29. An auxiliary reflector as set forth in claim 17 comprising a curved inner surface shaped to reflect substantially all light downwardly towards the work surface and substantially no light back at said lamp.

30. A retrofit kit for retrofitting a gaseous discharge luminaire having a gaseous discharge lamp of a first wattage positioned within an outer reflector to accept a gaseous discharge lamp of a reduced wattage without decreasing the illumination of the work area under said luminaire comprising:

a ballast compatible with a specified lamp of reduced wattage;

an auxiliary reflector adapted to be mounted to said luminaire within said outer reflector and coaxially about said lamp of reduced wattage; and means for connecting said auxiliary reflector to said luminaire and adjusting said auxiliary reflector relative to said lamp of reduced wattage so that a substantial portion of the light emanating from said lamp of reduced wattage is concentrated in a first predetermined pattern which is substantially larger than the diameter of said outer reflector.

31. A retrofit kit as set forth in claim 30 wherein said kit further includes a gaseous discharge lamp of specified type having a wattage less than said lamp of first wattage.

32. A retrofit kit as set forth in claim 30 wherein said luminaire includes a lamp socket and said connecting and adjustment means includes a bracket assembly having a first end clamped to said lamp socket and a second end connected to the top of said auxiliary reflector.

33. A retrofit kit as set forth in claim 30 wherein said luminaire includes a lamp socket and said connecting and adjusting means includes a flexible band adapted to be clamped about said lamp socket;

a plurality of angled brackets connected to said flexible band; and a plurality of fasteners, each having one end connected to said auxiliary reflector and the other end connected to one of said angled brackets.

34. A retrofit kit as set forth in claim 30 wherein said auxiliary reflector is adapted to be mounted concentrically within said outer reflector.

35. A retrofit kit as set forth in claim 34 wherein said lamp of reduced wattage has an arc tube therein and the height of said auxiliary reflector is less than the length of said arc tube.

36. A retrofit kit as set forth in claim 35 wherein said auxiliary reflector has a curved inner surface shaped to reflect substantially all of the light impinging on said inner surface downwardly towards the work surface.

37. A retrofit kit as set forth in claim 30 wherein said outer reflector is rectangular in cross-section and said auxiliary reflector is circular in cross-section.

38. A dual reflector assembly adapted to be mounted to a housing of a lighting fixture having a gaseous discharge lamp comprising:

an outer reflector;

an inner reflector smaller than the outer reflector and adapted to fit within said outer reflector coaxially about said gaseous discharge lamp to reflect a substantial amount of light from said lamp onto an area substantially larger than the diameter of said outer reflector; and means connecting said outer reflector and said inner reflector for adjusting said inner reflector relative to said outer reflector.

39. A dual reflector assembly as set forth in claim 38 wherein said inner reflector is mounted concentrically within said outer reflector.

40. A dual reflector assembly as set forth in claim 38 including means for connecting the outer reflector to said housing of said fixture.

41. An auxiliary reflector assembly adapted to be mounted to a lighting fixture having a main reflector and a gaseous discharge lamp comprising:

an auxiliary reflector; and means for mounting said auxiliary reflector to said lighting fixture concentrically within said main reflector in a position that said auxiliary reflector reflects a first portion of light from said lamp onto a first predetermined area substantially larger than the outer perimeter of said main reflector.

42. An auxiliary reflector assembly as set forth in claim 41 wherein said mounting means includes means for adjusting the position of said auxiliary reflector relative to said lamp.

43. An auxiliary reflector assembly as set forth in claim 41 for mounting to a fixture in which the gaseous discharge lamp has an arc tube therein, wherein the height of said auxiliary reflector is less than the length of said arc tube.

44. An auxiliary reflector assembly adapted to be mounted to a lighting fixture having a main reflector, a lamp socket and a gaseous discharge lamp comprising:

an auxiliary reflector; and means for connecting said auxiliary reflector to said lamp socket in a position such that said auxiliary reflector reflects a first portion of light from said lamp onto a first predetermined area substantially larger than the perimeter of the outer reflector.

45. An auxiliary reflector assembly as set forth in claim 44 wherein said connecting means includes means for adjusting the position of said auxiliary reflector relative to said lamp.

46. An auxiliary reflector assembly as set forth in claim 44 for mounting to a fixture in which the gaseous discharge lamp has an arc tube therein, wherein the height of said auxiliary reflector is less than the length of said arc tube.

* * * * *